US007553526B2

(12) United States Patent
Campbell et al.

(10) Patent No.: US 7,553,526 B2
(45) **Date of Patent: *Jun. 30, 2009**

(54) INKJET RECORDING MEDIA COMPRISING PRECIPITATED CALCIUM CARBONATE

(75) Inventors: Bruce C. Campbell, Webster, NY (US); Kenneth J. Ruschak, Rochester, NY (US); Thomas P. Nicholas, Rochester, NY (US); Lisa B. Todd, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 137 days.

This patent is subject to a terminal disclaimer.

(21) Appl. No.: 11/302,875

(22) Filed: Dec. 14, 2005

(65) Prior Publication Data

US 2007/0134450 A1 Jun. 14, 2007

(51) Int. Cl.
*B41M 5/40* (2006.01)

(52) U.S. Cl. ..... 428/32.21; 428/32.26; 428/32.28; 428/32.3; 428/32.35

(58) Field of Classification Search ..... 428/32.25, 428/32.26, 32.28, 32.3, 32.35, 32.21
See application file for complete search history.

(56) References Cited

U.S. PATENT DOCUMENTS

| | | | | |
|---|---|---|---|---|
| 5,783,038 | A * | 7/1998 | Donigian et al. | 162/135 |
| 5,879,442 | A * | 3/1999 | Nishiguchi et al. | 106/464 |
| 6,150,289 | A | 11/2000 | Chen et al. | |
| 6,242,082 | B1 * | 6/2001 | Mukoyoshi et al. | 428/32.18 |
| 6,379,780 | B1 | 4/2002 | Lancy et al. | |
| 6,689,430 | B2 | 2/2004 | Sadasivan et al. | |
| 2001/0009712 | A1 * | 7/2001 | Totani et al. | 428/195 |
| 2002/0142138 | A1 | 10/2002 | Bermel et al. | |
| 2003/0113516 | A1 | 6/2003 | Wang et al. | |
| 2005/0098066 | A1 * | 5/2005 | Lunden et al. | 106/464 |

FOREIGN PATENT DOCUMENTS

| | | |
|---|---|---|
| EP | 1 081 197 A1 | 3/2001 |
| EP | 1 319 518 A2 | 6/2003 |

* cited by examiner

*Primary Examiner*—Betelhem Shewareged
(74) *Attorney, Agent, or Firm*—Chris P. Konkol; Arthur E. Kluegel

(57) ABSTRACT

The invention relates generally to the field of inkjet recording media and inkjet printing methods. More specifically, the invention relates to a porous base layer of an inkjet recording element, the base layer comprising precipitated calcium carbonate having scalenohedral morphology.

21 Claims, 2 Drawing Sheets

INKJET RECORDING MEDIA COMPRISING PRECIPITATED CALCIUM CARBONATE

FIELD OF THE INVENTION

The invention relates generally to the field of inkjet recording media and printing methods. More specifically, the invention relates to a porous base layer of an inkjet recording element, the base layer comprising precipitated calcium carbonate having scalenohedral morphology.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of an aqueous mixture, for example, comprising water and one or more organic materials such as a monohydric alcohol, a polyhydric alcohol, or the like.

An inkjet recording element typically comprises a support having on at least one surface thereof at least one ink-receiving layer. There are generally two types of ink-receiving layers (IRL's). The first type of IRL comprises a non-porous coating of a polymer with a high capacity for swelling, which non-porous coating absorbs ink by molecular diffusion. Cationic or anionic substances may be added to the coating to serve as a dye fixing agent or mordant for a cationic or anionic dye. Typically, this coating is optically transparent and very smooth, leading to a very high gloss "photo-grade" receiver. However, this type of IRL usually tends to absorb the ink slowly into the IRL and, consequently, the imaged receiver or print is not instantaneously dry to the touch.

The second type of ink-receiving layer or IRL comprises a porous coating of inorganic, polymeric, or organic-inorganic composite particles, a polymeric binder, and optional additives such as dye-fixing agents or mordants. These particles can vary in chemical composition, size, shape, and intraparticle porosity. In this case, the printing liquid is absorbed into the open interconnected pores of the IRL, substantially by capillary action, to obtain a print that is instantaneously dry to the touch. Typically the total interconnected interparticle pore volume of porous media, which may include one or more layers, is more than sufficient to hold all the applied ink forming the image.

Basically, organic and/or inorganic particles in a porous layer form pores by the interstitial spacing between the particles. The binder is used to hold the particles together. However, to maintain a high pore volume, it is desirable that the amount of binder is as low as possible. Too much binder would start to fill the pores between the particles or beads, which will reduce ink absorption. Too little binder may reduce the integrity of the coating causing cracking. Once cracking starts in an inkjet coating, typically at the bottom of the layer, it tends to migrate throughout the layer.

A porous IRL that is glossy usually comprises at least two layers, a base layer and a glossy image-receiving layer. When coated on plain paper, the base layer is laid down underneath the glossy image-receiving layer, that is, the base layer is located between the image-receiving layer and the support. In order to provide a smooth, glossy surface on the image-receiving layer, special coating processes are often utilized, such as cast coating and film transfer coating. Calendaring, with heat and pressure, is also used in combination with conventional blade, rod, or air-knife coating on plain paper to produce a glossy image-receiving layer.

For porous coated papers, one of the main functions of the base layer is to provide a sump for the ink fluids. As the quality and density of inkjet images increases, so does the amount of ink applied to the inkjet receiver. For this reason it is important provide sufficient void capacity in the base layer. Although many types of inorganic or organic particles can be used in the base layer, calcium carbonate particles has been found useful to provide enough void capacity when coated on a substrate. Calcium carbonate can be natural (ground) or synthetically made (precipitated) and can come in a variety of sizes and shapes.

A requirement for porous inkjet paper manufacture is that the coating compositions used to make the porous layers are compatible with modern coating and drying equipment. Modem coating and drying methods in the paper coating industry have evolved to high levels of efficiency. These methods include blade and rod coating, mentioned above, that are capable of high coating speeds that contribute to manufacturing efficiency. Coating compositions for porous layers (sometimes referred to as "coating colors") comprise particles such as, for example, pigment dispersions, wherein pigments refer to inorganic particles. The coating compositions comprise a high concentration of solids for drying efficiency and, in fact, the common coating methods will not work unless the particles are sufficiently concentrated. Dryers are typically gas fired and operate at temperatures in excess of 200° C. As a result of the high solids concentrations and hot dryers, energy usage and dryer lengths are minimized.

In general, inkjet base-layer coatings typically have high dry coverage compared to common coated papers. For example, typical dry coverage for inkjet base-layer coatings is 10 grams per square meter or more ($\geqq 10$ g/m$^2$). The base-layer coatings also have to be highly porous to absorb the aqueous ink carrier solvents deposited during inkjet printing.

For rod coating, dry coverage increases with coating solids concentration. Thicker layers using self-metered methods such as rod and blade require relatively higher solids concentrations, whereas thinner layers may use coatings with relatively lower solids concentrations. Typically the solids concentration of coating compositions used for the rod and blade coating of base layers in inkjet media is in the range of 50% to 70% by weight. The solids concentration must be high enough that the particle concentration approaches close packing where flow cannot occur. The viscosity of such coatings typically falls rapidly as shear rate is increased and plateaus at high shear rates to a viscosity value called the high shear viscosity. For rod coating, the high shear viscosity is typically in the range of 0.1 to 1 poise.

In the prior art, the necessary porosity for a porous layer has been achieved by using microporous pigments at least in part, that is, pigment particles that are themselves porous. Silica gels and fumed aluminas are examples of microporous pigments. However, these materials can be costly and difficult to disperse at high solids. In dispersion, microporous pigments absorb and immobilize part of the liquid phase with the result that the viscosity of the coating composition greatly increases. At particle concentrations approaching close packing, the liquid in the micropores represents a drying penalty. In addition, formulations too high in viscosity are impractical to handle. Pumping, deaerating, filtering and mixing are examples of standard operations that can be compromised by an overly high viscosity. Microporous pigments can also be difficult to handle in the dry state and to disperse. As a consequence, the quantity of microporous pigments that can be used in a coating composition can be limited. While these operating difficulties can be relieved by adding enough water, the coating composition may be made too dilute for coating and the desired drying efficiency, especially for a base layer.

An alternative way to produce highly porous coatings is to employ structured pigments in which the dispersed particles have low or no internal porosity. These may less expensive than microporous pigments. Structured pigments have a non-spherical morphology that does not allow dense packing in the dried coating. In the coating composition, structured pigments immobilize less water than microporous pigments and so do not have the inherent drying penalty. They may be able to be dispersed at the required concentrations without causing unmanageable viscosity.

Precipitated calcium carbonate (PCC) is an example of a structured pigment that can provide high porosity in inkjet coatings. For example, precipitated calcium carbonate having scalenohedral morphology has been used to provide absorption of inkjet-printing inks.

U.S. Pat. No. 6,150,289 to Chen discloses a coating composition intended for a matte-grade inkjet paper comprising engineered calcined clay dispersed with a cationic polymer and compares this with a composition comprising scalenohedral precipitated calcium carbonate (PCC) particles, binders and crosslinker. At relatively low solids (less than 35%), no rheology problems are mentioned and no suggestion of mixing different morphologies of precipitated calcium carbonate (PCC) particles is made.

U.S. Pat. No. 5,783,038 to Donigan discloses an inkjet recording element coated with precipitated calcium carbonate (PCC) particles milled and heat-aged in the presence of an organo-phosphonate compound. The precipitated calcium carbonate particles may be selected from scalenohedral, acicular, prismatic or rhombohedral morphology. No teaching is provided regarding preferred particle morphology, a mixture of particle morphologies, or coatability on a manufacturing scale at high solids concentration with rod or blade coating apparatus.

U.S. Pat. No. 6,379,780 to Laney discloses a two-layer film laminate comprising an impermeable base polyester layer and an absorbing top polyester layer comprising a filler of a scalenohedral form of precipitated calcium carbonate (PCC). In this example, the recording elements are produced by an entirely different process comprising extrusion, stretching, and tentering, to generate voids, rather than being coated from aqueous coating composition and dried.

U.S. Pat. No. 6,689,430 to Sadasivan discloses an inkjet recording element comprising a base layer comprising prismatic particles of precipitated calcium carbonate (PCC) and silica gel.

U.S. Pat. No. 5,879,442 to Nishiguchi et al. describes a method of preparing aqueous slurries of mixtures of precipitated calcium carbonate and ground calcium carbonate for coatings of papers. The relative weight proportions of precipitated and ground calcium carbonate particles are from 20:80 to 80:20.

PROBLEM TO BE SOLVED BY THE INVENTION

The choice of type and shape of calcium carbonate in the base layer has been found to significantly impact the overall void capacity and the rate at which it takes up the applied ink fluid. The problem remains to provide a highly porous layer coatable from an aqueous coating composition at high solids concentration for efficient coating and drying.

Precipitated calcium carbonate having scalenohedral morphology, as a pigment by itself, provides absorption of inkjet-printing inks. However, at the concentrations required for coating, scalenohedral precipitated calcium carbonate has been found to exhibit an undesirable flow property called shear thickening and sometimes dilatancy. In this case, viscosity climbs once a certain shear rate is exceeded. The coating composition in effect develops a very high resistance to flow that can make dispersing, mixing, pumping and coating operations impossible. This behavior can be detected in the laboratory. A standard way to recognize shear thickening behavior is to use instruments called rheometers. While shear thickening can be eliminated by sufficiently diluting the solids concentration, the desired coating and drying capabilities are thereby lost.

SUMMARY OF THE INVENTION

The present invention is directed to overcoming one or more of the problems set forth above. It is an object of this invention to provide an image recording element with high ink capacity and fast drying time. It is a further object of this invention to provide an aqueous coating composition with high solids concentration compatible with advantageous coating and drying operations, particularly rod coating. It is yet a further object of this invention to provide a method of rod coating an aqueous coating composition of high solids concentration to form a highly porous layer of an inkjet recording element. It is a further object of this invention to provide a printing method for printing on an inkjet recording element wherein the element is capable of being coated by advantageous production methods and provides a fast dry time.

These and other objects are achieved in accordance with the invention, which comprises an inkjet recording element comprising a support having thereon:

(a) a porous image-receiving layer; and (b) under the porous image-receiving layer, a base layer comprising a polymeric binder and at least 80% by weight of inorganic particles, wherein at least 80% by weight of the inorganic particles comprise precipitated calcium carbonate, the precipitated calcium carbonate comprising at least 25 percent by weight of particles having scalenohedral morphology and at least 5% of precipitated calcium carbonate particles characterized by a morphology other than scalenohedral.

Another aspect of the invention relates to an inkjet printing method comprising the steps of: (a) providing an inkjet printer that is responsive to digital data signals; (b) loading the inkjet printer with the inkjet recording element described above; (c) loading the inkjet printer with an inkjet ink composition; and (d) printing on the inkjet recording element using the inkjet ink composition in response to the digital data signals.

Still another aspect of the present invention relates to a method of manufacturing an inkjet recording element as described above.

The term "porous layer" is used herein to define a layer that is characterized by absorbing applied ink by means of capillary induced flow into voids rather than liquid diffusion through a continuous medium. The porosity is based on pores formed by the interstitial spacing between particles, although porosity can be affected by the amount and type of binder. The porosity of a mixture may be predicted to some extent based on the critical pigment volume concentration (CPVC). An inkjet recording element having one or more porous layers, preferably substantially all layers, over the support can be referred to as a porous inkjet recording element.

As used herein, the terms "over," "above," "upper," "under," "below," "lower," and the like, with respect to layers in inkjet media, refer to the order of the layers over the support, but do not necessarily indicate that the layers are immediately adjacent or that there are no intermediate layers.

In regard to the present method, the term "image-receiving layer" is intended to define a layer that is used as a pigment-trapping layer, dye-trapping layer, or dye-and-pigment-trapping layer, in which the printed image substantially resides throughout the layer. Preferably, an image-receiving layer comprises a mordant for dye-based inks. In the case of a dye-based ink, the image may optionally reside in more than one image-receiving layer. Pigment particles tend to be trapped at or near the top of the surface, depending upon the relative pore size and particle size.

In regard to the present method, the term "ink-carrier-liquid receptive layer" (sometimes also referred to as a "sump layer" or "base layer") is used herein to mean a layer under the image-receiving layer that absorbs a substantial amount of ink-carrier liquid. In use, a substantial amount, preferably most, of the carrier fluid for the ink is received in the ink-carrier-liquid layer or layers. The base layer is not above an image-containing layer and is not itself an image-containing layer (a pigment-trapping layer or dye-trapping layer). Preferably, there is a single ink-carrier-liquid receptive layer comprising calcium carbonate.

The term "ink-receptive layer" or "ink-retaining layer" includes all layers that are receptive to an applied ink composition, that absorb or trap any part of the one or more ink compositions used to form the image in the inkjet recording element, including the ink-carrier fluid and/or the colorant. An ink-receptive layer, therefore, can include either an image-receiving layer, in which the image is formed by a dye and/or pigment, or an ink-carrier-liquid receptive layer in which the carrier liquid in the ink composition is absorbed upon application, although later removed by drying. Typically, all layers above the support are ink-receptive and the support may or may not be ink-receptive.

The term "precipitated calcium carbonate" is used herein to define a synthetically produced calcium carbonate, not based on calcium carbonate found in nature.

ADVANTAGEOUS EFFECT OF THE INVENTION

By use of the present invention, a recording element can be obtained that exhibits high ink capacity and excellent dry time and can be manufactured by rod (or other self-metering methods) coating an aqueous coating composition having a high concentration of solids. It has been found that blending scalenohedral-shaped calcium carbonate with one or more other precipitated calcium carbonate pigments can eliminate shear thickening and allow the scalenohedral calcium carbonate to be used in coating compositions ("colors") at levels high enough to give excellent absorption of inkjet-printing inks.

BRIEF DESCRIPTION OF THE DRAWINGS

The above and other objects, features, and advantages of the present invention will become more apparent when taken in conjunction with the following description and figures, wherein.

DETAILED DESCRIPTION OF THE INVENTION

Figure 1:
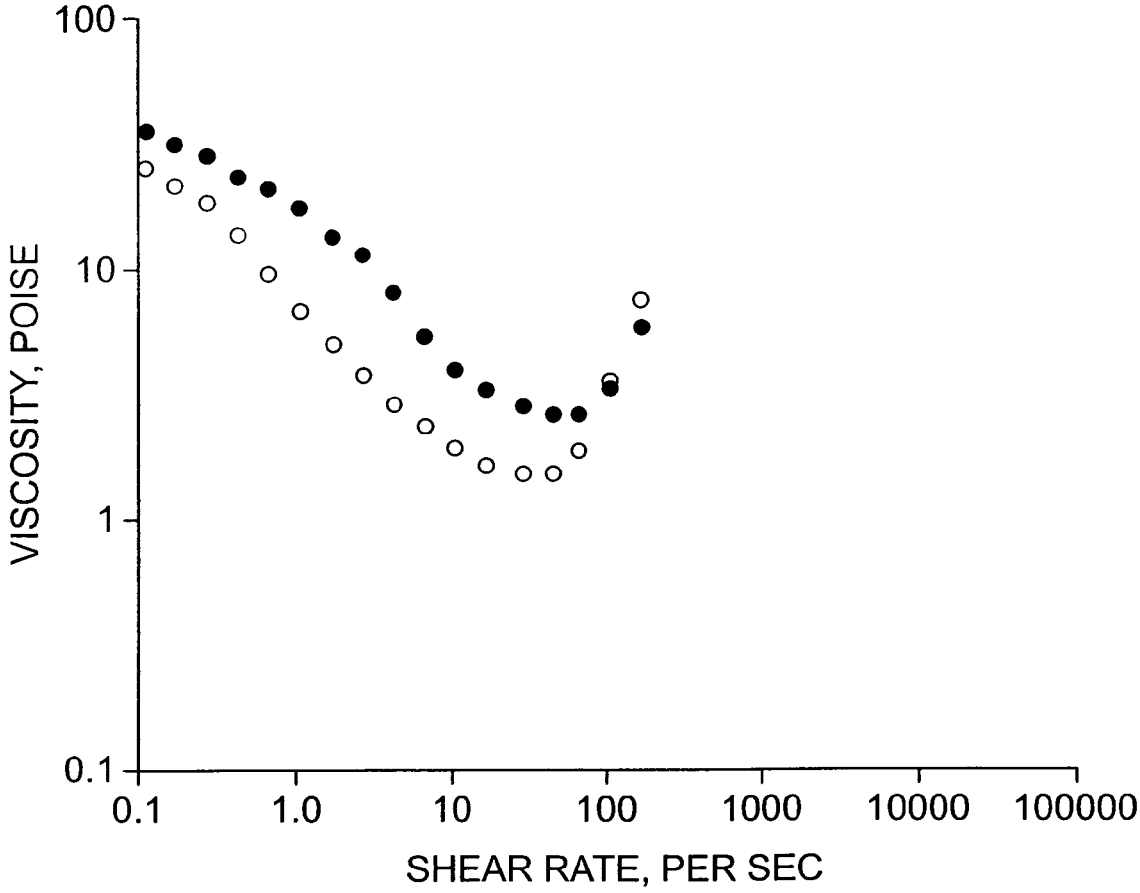
FIG. 1 is a graph of the viscosity, at increasing shear rates, as measured on a rheometer, for the coating composition of Comparative Example 1, comprising precipitated calcium carbonate having exclusively scalenohedral morphology.

As indicated above, the present invention relates to the use of precipitated calcium carbonate having scalenohedral morphology in a porous base layer of an inkjet recording element. In particular, in one embodiment of the invention, an inkjet recording element comprises a support having thereon:

(a) a porous image-receiving layer; and (b) under the porous image-receiving layers, a base layer comprising a binder, preferably in an amount of 3 to 20 weight %, and at least 80% by weight of inorganic particles, wherein at least 80% by weight of the inorganic particles comprise precipitated calcium carbonate, preferably having an average particle size of 0.1 to 5 micrometers, wherein the precipitated calcium carbonate comprises at least 25 percent by weight of scalenohedral particles and at least 5% of calcium carbonate particles having morphology selected from the group consisting of prismatic, acicular, rhombohedral, and spherical, and combinations thereof.

In one preferred embodiment, the calcium-carbonate-containing base layer is used as a substrate or base layer immediately or directly below a porous image-receiving layer. In this case, it is preferred that the voids in the ink-receiving layer are open to (connect with) the voids in the calcium-carbonate-containing base layer for optimal interlayer absorption.

In a preferred embodiment of the invention, the ratio of the scalenohedral calcium carbonate to the other particles of precipitated calcium carbonate is from 90:10 to 25:75, based on the dry weight of the precipitated calcium carbonate particles. Preferably, the scalenohedral calcium carbonate is present in an amount of at least 20 weight percent, preferably at least 25 weight percent based on the total dry weight of all the pore-forming particles in the base layer including optional other inorganic and/or organic particles.

The use of a calcium-carbonate-containing layer according to the present invention can provide desired or improved porosity compared to other particles, inorganic or inorganic, used in porous base layers of many other inkjet-recording elements. Alternatively, the scalenohedral calcium carbonate can be used to adjust the porosity of the layer, for example, to provide a porosity that better matches the porosity of an adjacent layer. A calcium-carbonate-containing layer, and its attendant structure, according to the present invention, is capable of providing fast dry times with very heavy ink lay-down volumes.

Another aspect of the invention relates to an inkjet printing method comprising the steps of: (a) providing an inkjet printer that is responsive to digital data signals; (b) loading the inkjet printer with the inkjet recording element described above; (c) loading the inkjet printer with a pigmented and/or dye-based inkjet ink; and (d) printing on the inkjet recording element using the inkjet ink in response to the digital data signals.

Examples of scalenohedral calcium carbonate that can be used in the invention include various ALBACAR PCC products available from Specialty Minerals Inc. (subsidiary of Minerals Technologies Inc.). Scalenohedral PCC materials available from Specialty Minerals include ALBACAR HO, ALBACAR 5970 and ViCALity® Extra Light.

Examples of other types of precipitated calcium carbonate, which may be useful in practicing the invention, include ALBAGLOS and ALBAFIL PCC's (prismatic), OPACARB PCC (acicular), and ViCALity® Heavy PCC (cubic), products also available from Specialty Minerals Inc. Other companies making PCC's include Pfizer and Solvay.

For use in the calcium-carbonate-containing layer of the present invention, the average size (diameter or equivalent diameter) of the calcium carbonate particles (for each morphology) can suitably vary in length from 0.1 μm to 5 μm, with a preferred size of less than 3 μm, more preferably less than 2 μm, most preferably about 0.3 to 2 μm.

Precipitated calcium carbonate (PCC) can be produced by several methods but, in the U.S., is normally produced by a carbonation process involving bubbling a gas containing carbon dioxide through an aqueous suspension of calcium hydroxide or milk-of-lime in a carbonator reactor. Other inorganic materials such as alum can be co-precipitated with PCC or can be precipitated onto the surface of the PCC precipitate. U.S. Pat. No. 5,783,038 to Donigan et al., for example, discloses one particular method of making precipitated carbonate pigment, although variations in the specific synthetic pathway, optional additives or agents, process conditions, and post-precipitation physical or chemical treatments, can be used to vary the particle size, morphology, and nature of the pigment surface, as will be understood by the skilled artisan. Precipitated calcium carbonate (PCC) differs greatly from natural ground calcium carbonate in its physical and chemical properties.

Calcium carbonate occurs in three crystal structures: calcite, aragonite and (rarely) vaterite. Aragonite is commonly in the acicular form, whereas calcite can form scalenohedral, prismatic, spherical, and rhombohedral forms of PCC. Aragonite changes to calcite when heated to about 400° C. in dry air. The use of additives and dopants in the preparation of precipitated calcium carbonate can change the habit to a specific morphology. Soluble additives can selectively stabilize certain crystal faces of $CaCO_3$, and, therefore provide control of the habit of $CaCO_3$ through molecular recognition. Recognition is mediated by electrostatic, geometric and stereochemical interactions between the additives and specific crystal faces. The design and activity of tailor-made additives is now well established and known to the skilled artisan. For example, transition metal cations have a marked impact on the morphology and habit of $CaCO_3$, even at very low concentrations.

Another embodiment of the present invention comprises an inkjet recording element comprising a support having thereon a base layer comprising scalenohedral calcium carbonate in admixture with precipitated calcium carbonate particles of different morphology or morphologies, as described above and, in addition, optionally up to 20 percent by weight of other particles, based on the total weight of inorganic particles, either organic and/or other inorganic particles, including organic-inorganic composite particles.

Examples of organic particles that may be used in this layer include polymer beads, including but not limited to acrylic resins such as methyl methacrylate, styrenic resins, cellulose derivatives, polyvinyl resins, ethylene-allyl copolymers and polycondensation polymers such as polyesters. Hollow styrene beads are a preferred organic particle for certain applications.

Other examples of organic particles which may be used include core/shell particles such as those disclosed in U.S. Pat. No. 6,492,006 and homogeneous particles such as those disclosed in U.S. Pat. No. 6,475,602, the disclosures of which are hereby incorporated by reference.

Examples of inorganic particles that may be used, in addition to the precipitated calcium-carbonate particles in the base layer, include silica, alumina, titanium dioxide, clay, talc, calcined clays calcium carbonate, barium sulfate, or zinc oxide. In one preferred embodiment, the calcium-carbonate-containing layer further comprises porous alumina or silica in a crosslinked poly(vinyl alcohol) binder.

In a preferred embodiment, the average primary particle size of the optional additional organic or inorganic particles is about 0.3 μm (300 nm) to about 5 μm, preferably 0.5 μm (500 nm) to less than 1.0 μm. A plurality of inorganic particles such as alumina may agglomerate into larger secondary particles. As mentioned above, smaller particles provide smaller capillaries, but tend to be more prone to cracking because binder starved in view of the large surface area created by the particles. On the other hand, particles that are too large may be brittle or prone to cracking because of fewer contact points, for example, if the coating has a thickness equal to only a few beads making up the dried coating.

In a preferred embodiment of the invention, the porous calcium-carbonate-containing layer comprises between 75% by weight and 98% by weight of particles and between about 2% and 25% by weight of a polymeric binder, preferably from about 82% by weight to about 96% by weight of particles and from about 18% by weight to about 4% by weight of a polymeric binder, most preferably about 4 to 10% by weight of binder. In one embodiment, about 100 percent of the particles in the calcium-carbonate-containing layer are precipitated calcium-carbonate particles, in the absence of organic or other inorganic particles or beads.

As mentioned above, the amount of binder is desirably limited, because when ink is applied to inkjet media, the (typically aqueous) liquid carrier tends to swell the binder and close the pores and may cause bleeding or other problems. Preferably, therefore, the base layer comprises less than 25 weight percent of binder, to maintain porosity, although higher levels of binder may be used in some cases to prevent cracking.

Any suitable polymeric binder may be used in the base layer of the inkjet recording element employed in the invention. In a preferred embodiment, the polymeric binder may be a compatible, preferably hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin. In general, good results are also obtained with polyurethanes, vinyl acetate-ethylene copolymers, ethylene-vinyl chloride copolymers, vinyl acetate-vinyl chloride-ethylene terpolymers, acrylic polymers, or derivatives thereof. Preferably, the binder is a water-soluble hydrophilic polymer, most preferably polyvinyl alcohol or the like.

Other binders can also be used such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like. A poly(styrene-co-butadiene) latex is preferred. Mixtures of hydrophilic and latex binders are useful, and a mixture of PVA with a poly(styrene-co-butadiene) latex is particularly preferred.

In order to impart mechanical durability to the calcium-carbonate-containing layer, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate, boric acid or a borate salt and the like may be used. Preferably, the crosslinker is an aldehyde, an acetal or a ketal, such as 2,3-dihydroxy-1,4-dioxane.

The calcium-carbonate-containing base layer is typically at least 10 μm in thickness (dried), more preferably at least 15 μm or 20 μm, depending on the presence of other liquid-carrier absorbing layers, most preferably about 30 to 60 μm. For example, in one embodiment, the calcium-carbonate-containing layer is 35 to 70 μm thick. In the case of an inkjet recording element with a porous support such as paper, the preferred thickness of the calcium-carbonate-containing layer may be slightly less, for example, 20 μm to 60 μm thick, preferably at least 25 μm.

As indicated below, other conventional additives may be included in the calcium-carbonate-containing base layer, which may depend on the particular use for the recording element. In the case of an inkjet recording element designed for use with dye-based inks to image element, the calcium-carbonate-containing layer can comprise a mordant, for example, of a type described in more detail below.

The calcium-carbonate-containing layer according to the present invention is located under at least one image-receiving layer and absorbs a substantial amount of the liquid carrier applied to the inkjet recording element, but substantially less dye or pigment than the overlying layer or layers.

The porous image-receiving layer contains interconnecting voids that can provide a pathway for the liquid components of applied ink to penetrate appreciably into the calcium-carbonate-containing layer, thus allowing the calcium-carbonate-containing layer to contribute to the dry time. A non-porous image-receiving layer or a porous image-receiving layer that contains closed cells would not allow the substrate to contribute to the dry time.

Interconnecting voids in an image-receiving layer may be obtained by a variety of methods. For example, the layer may contain particles dispersed in a polymeric binder. The particles may be organic such as poly(methyl methacrylate), polystyrene, poly(butyl acrylate), etc. or inorganic such as silica, alumina, zirconia, titania, calcium carbonate, and barium sulfate. In a preferred embodiment of the invention, the particles in the image-receiving layer have a particle size of from about 5 nm to about 15 μm Polymeric binders that can be used in the image-receiving layer of the invention include, for example, hydrophilic polymers such as poly(vinyl alcohol), polyvinyl acetate, polyvinyl pyrrolidone, gelatin, poly(2-ethyl-2-oxazoline), poly(2-methyl-2-oxazoline), poly(acrylamide), chitosan, poly(ethylene oxide), methyl cellulose, ethyl cellulose, hydroxyethyl cellulose, hydroxypropyl cellulose, etc. Other binders that can be used include hydrophobic materials, for example, poly(styrene-co-butadiene), polyurethane latex, polyester latex, poly (n-butyl acrylate), poly(n-butyl methacrylate), poly(2-ethylhexyl acrylate), copolymers of n-butylacrylate and ethylacrylate, copolymers of vinylacetate and n-butylacrylate, and the like.

The particle-to-binder weight ratio of the particles and optional binder employed in the porous image-receiving layer can range between about 100:0 and 60:40, preferably between about 100:0 and about 90:10. In general, a layer having particle-to-binder ratios outside the range stated will usually not be sufficiently porous to provide good image quality. In a preferred embodiment of the invention, the volume ratio of the particles to the polymeric binder in the image-receiving layer is from about 1:1 to about 15:1.

Additives that optionally can be included in the image-receiving layer include pH-modifiers like nitric acid, crosslinkers, rheology modifiers, water-retention aides, surfactants, UV-absorbers, biocides, lubricants, dyes, dye-fixing agents or mordants, optical brighteners, and other conventionally known additives. The base layer can independently and optionally include any of the additives found in the image-receiving layer.

An image-receiving layer may be applied to one or both support surfaces through conventional pre-metered coating methods (such as extrusion, curtain or slide hopper coating) or self-metered coating methods (such as blade, air knife, rod, roll coating, and the like). The choice of coating process typically determines coating speed and particular formulation specifications such as coating solids and coating viscosity.

The image-receiving layer thickness may range from about 1 to about 40 μm, preferably between 2 and 15 μm, more preferably between 4 and 10 μm.

The inkjet recording element can be specially adapted for either pigmented inks or dye-based inks, or designed for both. One embodiment of such a recording element comprises a support having thereon in order: (a) a porous pigment-trapping and/or dye-trapping layer comprising inorganic and/or organic particles and a binder; and (b) a base layer that is a calcium-carbonate-containing layer as described above.

The support may optionally function as an ink-carrier-receptive layer or sump layer in combination with the base layer.

The term "pigment-trapping layer" is used herein to mean that, in use, preferably at least about 75% by weight, more preferably substantially all, of the pigment colorant in the inkjet ink composition used to print an image remains in the pigment-trapping layer.

In the case of pigment-based inks, the calcium-carbonate-containing base layer receives the ink-carrier liquid after it has passed through the porous image-receiving layer where substantially all the pigmented colorant has been removed. In a preferred embodiment, the base layer is present in an amount from about 10 $g/m^2$ to about 50 $g/m^2$, more preferably from about 15 $g/m^2$ to about 45 $g/m^2$, more preferably 20 $g/m^2$ to about 40 $g/m^2$.

A dye mordant can be employed in the image-receiving and/or in the calcium-carbonate-containing layer, and or any optional intermediate layer, which mordant can be any material that is substantive to the inkjet dyes. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quaternary ammonium compounds, or basic polymers, such as poly(dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly(3-N,N,N-trimethyl-ammonium)propyl methacrylate chloride; a copolymer of vinylpyrrolidinone and vinyl(N-methylimidazolium chloride; and hydroxyethyl-cellulose derivatized with 3-N,N,N-trimethylammonium) propyl chloride. In a preferred embodiment, the cationic mordant is a polymer containing quaternary ammonium groups.

In order to be compatible with the mordant, both the binder and the polymer in the layer or layers in which it is contained should be either uncharged or the same charge as the mordant. Colloidal instability and unwanted aggregation could result if a polymer or the binder in the same layer had a charge opposite from that of the mordant.

In one embodiment, the porous image-receiving layer may comprise particles in an amount ranging from about 95 to about 60 parts by weight, the binder may range from about 40 to about 5 parts by weight, and the dye mordant may range from about 2 parts to about 40 parts by weight. More preferably, the image-receiving layer can, for example, comprises roughly about 80 parts by weight particles, about 10 parts by weight binder, and about 10 parts by weight dye mordant. In this embodiment, the dye-trapping layer is present in an amount from about 1 $g/m^2$ to about 50 $g/m^2$, preferably in an amount from about 1 $g/m^2$ to about 10 $g/m^2$, wherein the image-receiving layer is at least 10 percent thinner, preferably at least 25% thinner, than the base layer, which is present in an amount from about 10 $g/m^2$ to about 50 $g/m^2$, preferably from about 15 $g/m^2$ to about 45 $g/m^2$. The porous base layer is designed to receive the ink-carrier liquid after the ink has passed through the porous image-receiving layer where substantially all the dye in a dye-based imaging ink has been removed.

Whatever the particular type of recording element, whether designed for dye-based inks, pigmented inks or both, the recording element comprises, under the calcium-carbonate-containing base layer, a support which support may be opaque, translucent, or transparent. There may be used, for example, plain papers, resin-coated papers, various plastics including a polyester resin such as poly(ethylene terephthalate), poly(ethylene naphthalate) and poly(ester diacetate), polycarbonate resin, fluorine-containing resin such as poly (tetra-fluoro ethylene), metal foil, various glass materials, and the like. In a preferred embodiment, the support is a resin-coated paper or raw (uncoated) paper, more preferably the latter. The thickness of the support employed in the invention can be from about 12 to about 500 μm, preferably from about 75 to about 300 μm.

The support can also comprise an open-pore polyolefin, an open-pore polyester, or an open-pore membrane. An open-pore membrane can be formed in accordance with the known technique of phase inversion. Examples of a porous ink-receiving layers comprising an open-pore membrane are disclosed in U.S. Pat. No. 6,497,941 and U.S. Pat. No. 6,503,607, hereby incorporated by reference. An open-pore polyester is disclosed in U.S. Pat. No. 6,409,334, hereby incorporated by reference in its entirety.

If desired, in order to improve the adhesion of the base layer to the support, the surface of the support may be corona-discharge-treated prior to applying the base layer or solvent-absorbing layer to the support.

Since the inkjet recording element may come in contact with other image recording articles or the drive or transport mechanisms of image-recording devices, additives such as surfactants, lubricants, matte particles and the like may be added to the inkjet recording element to the extent that they do not degrade the properties of interest.

The layers described above, including the base layer, the image-receiving layer optional other layers, including subbing layers, overcoats, intermediate layers between the base layer and the image-receiving layer, etc. may be coated by conventional coating means onto a support material commonly used in this art. Coating methods may include, but are not limited to, wound wire rod coating, slot coating, slide hopper coating, gravure, curtain coating and the like. It may be advantageous, however, to rod coat the base layer. Some of these methods allow for simultaneous coatings of two or more layers, which is preferred from a manufacturing economic perspective. After coating, the inkjet recording element may be subject to calendaring or super-calendaring to enhance surface smoothness In another aspect of the invention, the inkjet recording element is manufactured by a method comprising coating a first coating composition over a substrate, preferably a paper support, in which the first coating composition is coated by a self-metering method such as blade or rod coating, preferably rod coated. The coating composition is an aqueous composition comprising at least 40 percent by weight solids, preferably 45 to 70 weight percent solids. The solids composition is as described above for the base layer composition of the inkjet recording element. Accordingly the solids comprise a polymeric binder and at least 80% by weight of inorganic particles, wherein at least 80% by weight of the inorganic particles comprise precipitated calcium carbonate, the precipitated calcium carbonate comprising at least 25 percent by weight of scalenohedral calcium carbonate particles and at least 5% of precipitated calcium carbonate selected from the group consisting of prismatic, acicular, rhombohedral, and spherical precipitated calcium carbonate, and combinations thereof. After being coated, the first coating composition is dried, calendared, and overcoated, directly or indirectly, with a second coating composition. The first coating composition forms a base layer and the second coating composition forms a porous image-receiving layer, most preferably a single image-receiving layer.

Yet another aspect of the invention is directed to an aqueous coating composition, for use in making an inkjet recording element as described above, comprising at least 40% by weight solids, preferably 45 to 70% by weight solids, which solids correspond to the composition of the above-described base layer. Accordingly, the coating composition comprises a polymeric binder and at least 80% by weight of inorganic particles, wherein at least 80% by weight of the inorganic particles comprise precipitated calcium carbonate, the precipitated calcium carbonate comprising at least 25 percent by weight of scalenohedral calcium carbonate particles and at least 5% by weight of precipitated calcium carbonate having other than scalenohedral morphology.

The present invention does not require, but permits, the use or addition of various organic and inorganic materials such as anti-block agents, antistatic agents, plasticizers, dyes, stabilizers, nucleating agents, and other addenda known in the art to an above-described layers. These materials may be incorporated into one or more of the coatings used to make the recording element using known techniques.

Inkjet inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. If dyes are used in such compositions, they are typically water-soluble direct or acid type dyes. Such liquid compositions have been described extensively in the prior art including, for example, U.S. Pat. Nos. 4,381,946; 4,239,543; and 4,781,758.

Although the recording elements disclosed herein have been referred to primarily as being useful for inkjet printers, they also can be used as recording media for pen plotter assemblies. Pen plotters operate by writing directly on the surface of a recording medium using a pen consisting of a bundle of capillary tubes in contact with an ink reservoir.

The following examples further illustrate the invention.

EXAMPLES

Measurements of Shear Thickening

Shear thickening behavior was measured using a standard commercially available instrument called a rheometer. The lower shear instrument used to make the rheology measurements was the ARES (Advanced Rheometric Expansion System) rheometer (made by TA Instrument, 1 Possumtown Rd., Piscataway N.J., 08854). The Couette fixture was used. The high shear instrument used to make rheology measurements was the Rheostress® RS150 rheometer (made by HAAKE Instruments Inc., 53 W. Century Road, Paramus, N.J. 07652). The double gap DG41 coaxial cylinders and high shear HS25 fixtures were used.

Shear-rate sweeps was performed in accordance with the common measurement practice. Shear sweeps are viscosity measurements over a range of values for shear rate. Three or four sweeps were carried out sequentially:

Sweep 1, low shear rate to high shear rate;
Sweep 2, high shear rate to low shear rate;
Sweep 3, low shear rate to high rate; and, in some cases,
Sweep 4, high shear rate to low shear rate.

Figure 2:
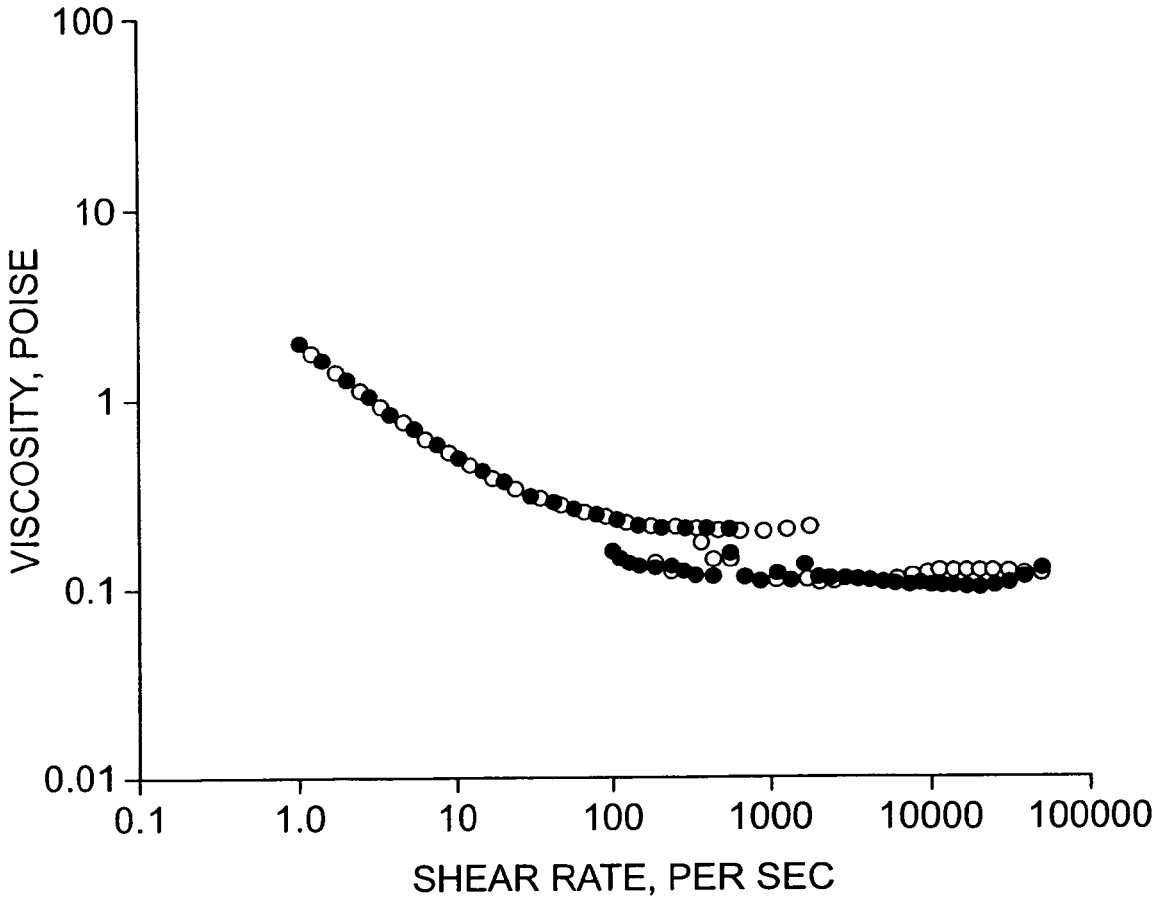
FIG. 2 is a graph of the viscosity, at increasing shear rates as measured on a rheometer, for the coating composition of Comparative Example 2, comprising precipitated calcium carbonate having exclusively prismatic morphology.

The first sweep typically breaks down any pigment structure in the coating color and is not shown. In FIGS. 1 and 2, the second sweep is shown by open symbols, and the third sweep is shown by solid symbols.

The higher shear rheometer shears the sample at a shear rate of 300 per sec before commencing the shear sweeps. Shear rates up to 50,000 per sec are achievable on the higher shear rheometer. Typically, the viscosity reaches a constant value at high shear rates. This limiting viscosity is usually called the high shear viscosity and is believed to be the viscosity relevant to the coating process. A high shear viscosity exceeding about 0.1 poise is necessary for rod coating.

Comparative Example 1

A coating color comprising 85 parts (dry) ALBACAR 5970 precipitated calcium carbonate, a structured pigment having scalenohedral morphology, and 15 parts (dry) CP692NA latex binder (Dow Chemical) was prepared in a lab at a solids concentration of 50.7%, the level anticipated for rod coating. The lower shear rheometer showed an abrupt rise in viscosity commencing at a shear rate of about 100 per sec indicating shear thickening behavior, as shown in FIG. 1. The higher shear rheometer quickly overloaded during the initial shearing at 300 per sec and failed to produce any data, and in particular a high shear viscosity could not be determined. In addition, difficulty was encountered loading the sample into the small gap. Upon unloading after the failed measurement, the sample appeared chalky. The composition also appeared to exhibit dilatancy.

Comparative Example 2

A coating color was prepared comprising 98.2 parts dry ALBAGLOS precipitated calcium carbonate (PCC), a conventional prismatic pigment, and 1.8 parts CP692NA Dow latex binder at a solids concentration of 67.7% solids. Shear thickening behavior was not found, and high shear viscosity was measured at 0.11 poise, as shown in FIG. 2. This color was successfully coated by the rod method.

Example 1

A coating composition was prepared comprising 46.55 parts ALBAGLOS S prismatic PCC (precipitated calcium carbonate), 49.11 parts ALBACAR HO-40 scalenohedral PCC, 0.16 parts COLLOID 211 dispersant, 2.09 parts CELVOL 325 PVA binder, and 2.09 parts CP692NA latex binder at a solids concentration of 53.5%. Shear thickening behavior was not found, and high shear viscosity was measured at 0.5 poise. This color was successfully coated by the rod method. In this case, the structured pigment was 51% of total pigment.

Thus, while the scalenohedral form of precipitated calcium carbonate by itself was not rod coatable, the mixture with the prismatic form could be successfully rod coated.

Example 2

Coating colors were prepared according to the formula used for the Bristow measurements in Table 1 except that the solids were 50%. The relative proportions of ALBACAR HO-40 and ALBAGLOS S precipitated calcium carbonate (PCC) were 50:50, 55:45, 60:40, 65:35, 70:30, and 75:25. In all cases, shear thickening behavior was not found, and the high shear viscosity measured was about 0.28 poise.

Example 3

This example shows the preparation of base layer coating compositions, at 50% solids, comprising even higher concentrations of scalenohedral calcium carbonate, up to 95% of the total precipitated calcium carbonate. A Comparative Coating Composition A was prepared comprising 50% solids, where ALBACAR HO PCC was 100% of the solids. (ALBACAR HO is a relatively smaller size scalenohedral PCC compared to ALBACAR 5970 precipitated calcium carbonate, mentioned above.) Since ALBACAR HO scalenohedral precipitated calcium carbonate (PCC) is commercially available as a 40% solids dispersion or as a solid, Comparative Coating Composition A was prepared using the available dispersion plus additional dry powdered ALBACAR HO PCC.

Inventive Coating Compositions B and C were prepared at 50% solids using a formula similar to Comparative Coating Composition A, but in which 25% and 5% of the ALBACAR HO was replaced by an equal weight of ALBAGLOS S, respectively. The compositions were obtained by blade mixing the following specific formulations:

Comparative Coating Composition A (Pigment 100% ALBACAR HO PCC):

(1) 29.2 g of water;
(2) 204.7 g of ALBACAR HO-40 precipitated calcium carbonate paste (Specialty Minerals Inc.) at 40 wt. %;
(3) 0.7 g of COLLOID 211 polyacrylate dispersant (Kemira) at 43 wt. %;
(4) 102.8 g of ALBACAR HO precipitated calcium carbonate (Specialty Minerals Inc.) at 100 wt. %;
(5) 20.4 g of styrene-butadiene latex CP692NA® (Dow Chemical Co.) at 49 wt. %;
(6) 40.0 g of CELVOL 325 polyvinyl alcohol (Celanese Corp.) at 10 wt. %; and (7) 2.2 g of CARTABOND GHF glyoxal (Clariant) at 46 wt. %.

Inventive Coating Composition B (Pigment 75:25 ALBACAR HO:ALBAGLOS-S PCC):

(1) 29.2 g of water;
(2) 65.0 g of ALBAGLOS-S precipitated calcium carbonate (Specialty Minerals Inc.) at 71 wt. %;
(3) 173.2 g of ALBACAR HO-40 precipitated calcium carbonate (Specialty Minerals Inc.) at 40 wt. %;
(4) 0.7 g of COLLOID 211 polyacrylate dispersant (Kemira) at 43 wt. %;
(5) 69.3 g of ALBACAR HO precipitated calcium carbonate (Specialty Minerals Inc.) at 100 wt. %;
(6) 20.4 g of styrene-butadiene latex CP692NA® (Dow Chemical Co.) at 49 wt. %;
(7) 40.0 g of CELVOL 325 polyvinyl alcohol (Celanese) at 10 wt. %; and
(8) 2.2 g of CARTABOND GHF glyoxal (Clariant) at 46 wt. %.

Inventive Coating Composition C (Pigment 95:5 Albacar HO:ALBAGLOS-S PCC):

(1) 13.0 g of ALBAGLOS-S precipitated calcium carbonate (Specialty Minerals Inc.) at 71 wt. %;
(2) 267.2 g of ALBACAR HO-40 precipitated calcium carbonate (Specialty Minerals Inc.) at 44 wt. %;
(3) 0.7 g of COLLOID 211 polyacrylate dispersant (Kemira Corp.) at 43 wt.%;
(4) 56.6 g of ALBACAR HO precipitated calcium carbonate (Specialty Minerals Inc.) at 100 wt. %;
(5) 20.4 g of styrene-butadiene latex CP692NA® (Dow Chemical Co.) at 49 wt. %;
(6) 40.0 g of CELVOL 325 polyvinyl alcohol (Celanese Corp.) at 10 wt. %; and
(7) 2.2 g of CARTABOND GHF glyoxal (Clariant Corp.) at 46 wt. %.

The state of each of the Coating Compositions A, B, and C was observed immediately upon mixing and again after 24 hours standing. Comparative Coating Composition A had the consistency of paste upon preparation and were not coatable. Inventive Coating Compositions B and C were fluid upon mixing and also upon standing for 24 hours. This shows that a minimum of 5 weight percent of the non-scalenohedral calcium carbonate maintained the coatability of the coating compositions containing the scalenohedral precipitated calcium carbonate.

Example 4

This example showed the effect of varying the composition on absorption characteristics of an inkjet image-recording element. In this example, the following inorganic particles were used:

ALBACAR HO-40 scalenohedral-shaped precipitated calcium carbonate at 40% solids, Specialty Minerals, Inc.;

ALBAGLOS S prismatic-shaped precipitated calcium carbonate at 71% solids, Specialty Minerals, Inc.;

OPACARB 40 acicular-shaped precipitated calcium carbonate at 71% solids, Specialty Minerals, Inc.; and Base layer coating compositions B-1 to B-11 were prepared according to the following formula: 92.35 parts by weight inorganic particles, 5 parts by weight styrene-butadiene latex CP692NA (Dow Chemicals) at 49% solids, 2 parts by weight poly(vinyl alcohol) CELVOL 325 (Celanese Corporation) at 10% solids, 0.5 parts by weight CARTABOND GHF glyoxal crosslinker (Clariant Corporation) at 46% solids, 0.15 parts by weight polyacrylate COLLOID 211 (Kemira Chemicals, Inc.) at 43% solids, and water in sufficient quantity to make a final base coating solution of 40% solids.

The inorganic particles (all calcium carbonate) in each of the base layer coating compositions were as given in Table 1 below:

TABLE 1

| Base Coating Composition | Scalenohedral PCC | Prismatic PCC | Acicular PCC |
|---|---|---|---|
| Comparative B-1 | 100% | | |
| B-2 | 90% | 10% | |
| B-3 | 75% | 25% | |
| B-4 | 50% | 50% | |
| B-5 | 25% | 75% | |
| Comparative B-6 | 10% | 90% | |
| Comparative B-7 | | 100% | |
| B-8 | 75% | | 25% |
| B-9 | 50% | | 50% |
| B-10 | 25% | | 75% |
| Comparative B-11 | | | 100% |

The base layer coating compositions B-1 to B-11 were bead-coated on to 65# QUANTUM Smooth cover paper (Domtar, Inc.) to yield a dry coating weight of approximately 27 g/m$^2$ for corresponding the base-coated papers P-1 to P-11.

These base-layer-coated papers were evaluated for ink absorption using the Bristow test method, described in ASTM test method D 5455. Fifty microliters of control ink, comprising 3 parts by weight BAYSCRIPT Cyan BA cyan dye (Bayer Chemical), 12 parts by weight diethylene glycol, 0.5 parts by weight SURFYNOL 465 (Air Products), 0.02 parts by weight PROXEL GXL biocide (Avecia), 0.3 parts by weight triethanolamine at 10%, and 84.18 parts by weight water, was measured into the application hopper. Bristow ink absorption values for each of the base-layer-coated papers were measured at a wheel rotational speed of 0.5 mm/s and 0.1 MPa hopper pressure and the results are shown in Table 2 below.

TABLE 2

| Base-coated papers | | Bristow Ink Absorption (ml/m$^2$) |
|---|---|---|
| P-1 | Comp. | 108.7 |
| P-2 | Inv | 106.2 |
| P-3 | Inv | 90.7 |
| P-4 | Inv | 46.6 |
| P-5 | Inv | 27.2 |
| P-6 | Comp | 21.7 |
| P-7 | Comp | 18.0 |
| P-8 | Inv | 79.7 |
| P-9 | Inv | 47.4 |
| P-10 | Inv | 25.4 |
| P-11 | Comp | 17.1 |

As can be seen from Table 2 above, the structured pigment ALBACAR HO PCC, by itself, in P-1, provides excellent ink absorption rate when coated as a base layer (even though such compositions failed the shear testing as described in previous examples). Up to 75% of a conventional pigment or mixture of conventional pigments, such as ALBAGLOS S and OPACARB 40 may be substituted in the coating composition for ALBACAR HO while maintaining acceptable Bristow value of at least about 25 ml/m$^2$.

To prepare image-recording elements, the base-coated papers P-1 to P-11 were overcoated with a top coating composition yielding a dry coating weight of approximately 5 g/m$^2$. The top coating solution was prepared by mixing the following components: 86.40 parts by weight CATAPAL 200 alumina (Sasol) at 35% solids, 3.77 parts by weight of a core/shell particle emulsion, 40% solids, as prepared by the procedure as described in Example 1 of U.S. Pat. No. 6,440,537, 3.75 parts by weight of GOHSENOL GH-17 poly(vinyl alcohol) (Nippon Gohsei Co., Ltd.) at 10% solids, 5 parts by weight of poly(vinylbenzyl trimethylammonium chloride-co-divinylbenzene) (87:13 molar ratio) emulsion at 15% solids, 0.15 parts by weight nitric acid, 0.62 parts by weight surfactant SILWET L-7230 (General Electric) at 100% active, 0.31 parts by weight surfactant SILWET L-7230 (General Electric) at 30% active, and water to make a final top coating solution at 20% solids.

After the coatings were dried, they were calendared at 500 psi and 115° F. Samples were then evaluated for ink absorption using the Bristow method previously described. The Bristow ink absorption values for the calendared top coated samples are shown in Table 3.

TABLE 3

| Top Coated Paper | Bristow Ink Absorption (ml/m$^2$) | |
|---|---|---|
| 1 | 18.4 | Comp |
| 2 | 19.9 | Inv |
| 3 | 17.5 | Inv |
| 4 | 15.9 | Inv |
| 5 | 15.8 | Inv |
| 6 | 14.1 | Comp |
| 7 | 13.2 | Comp |
| 8 | 16.9 | Inv |
| 9 | 16.9 | Inv |
| 10 | 15.6 | Inv |
| 11 | 13.2 | Comp |

The results in Table 3 show that an image-recording element comprising both a base layer and a top layer, wherein the base layer comprises solid particles comprising at least 25% by weight of scalenohedral-shaped PCC and at least 5% of other calcium carbonate particles provided an excellent ink absorption rate of at least 15 ml/m$^2$.

The invention has been described with reference to a preferred embodiment. However, it will be appreciated that variations and modifications can be effected by a person of ordinary skill in the art without departing from the scope of the invention.

The invention claimed is:

1. An inkjet recording element comprising in order:

(a) a porous image-receiving layer; and (b) a porous base layer comprising a polymeric binder and at least 80% by weight of inorganic particles, wherein at least 80% by weight of the inorganic particles comprise precipitated calcium carbonate, the precipitated calcium carbonate comprising at least 25% by weight of scalenohedral calcium carbonate particles and at least 5% by weight of precipitated calcium carbonate selected from the group consisting of prismatic precipitated calcium carbonate, acicular precipitated calcium carbonate, and combinations thereof; and (c) a porous paper support.

2. The inkjet recording element of claim 1 wherein the average particle size of the scalenohedral calcium carbonate particles is 0.1 to 5 micrometers.

3. The ink et recording element of claim 1 wherein the precipitated calcium carbonate comprises at least 10 percent by weight of precipitated calcium carbonate having other than scalenohedral morphology.

4. The inkjet recording element of claim 1 wherein the base layer comprises an admixture of scalenohedral and prismatic morphologies of precipitated calcium carbonate.

5. The inkjet recording element of claim 1 wherein the base layer comprises an admixture of scalenohedral and acicular morphologies of precipitated calcium carbonate.

6. The inkjet recording element of claim 1 wherein the base layer further comprises silica gel, which silica gel is present in an amount not more than 20 percent, based on the total weight of the inorganic particles.

7. The inkjet recording element of claim 1 wherein the binder in the base layer is present in the amount of 2 to 20 weight percent.

8. The inkjet recording element of claim 1 wherein the support is porous raw absorbent paper.

9. The inkjet recording element of claim 1 wherein the base layer is calendared.

10. The inkjet recording element of claim 1 wherein the binder in the base layer comprises poly(vinyl alcohol).

11. The inkjet recording element of claim 10 wherein the base layer further comprises crosslinker for the poly(vinyl alcohol).

12. The inkjet recording element of claim 1 wherein the base layer further comprises a polymeric latex.

13. The inkjet recording element of claim 12 wherein the latex comprises styrene-butadiene polymer.

14. The inkjet recording element of claim 1 consisting essentially of the porous image-receiving layer and the calcium-carbonate-containing base-layer over the support.

15. The inkjet recording element of claim 1 wherein the base layer is 20 to 70 μm thick.

16. The inkjet recording element of claim 1 wherein the porous image-receiving layer has interconnecting voids and comprises inorganic particles dispersed in a polymeric binder.

17. The inkjet recording element of claim 16 wherein the inorganic particles in the porous image-receiving layer comprise silica, alumina, zirconia, titania, calcium carbonate, or barium sulfate.

18. The inkjet recording element of claim 17 wherein the particles in the porous image-receiving layer are selected from the group consisting of fumed or colloidal silica, fumed or colloidal alumina, boelimite, and mixtures thereof, having an average primary particle size under 100 nm.

19. The inkjet recording element of claim 16 wherein the volume ratio of the particles to the polymeric binder is from about 1:1 to about 15:1.

20. The inkjet recording element of claim 1 wherein the porous image-receiving layer further comprises mordant.

21. An inkjet recording element comprising a porous paper support having thereon:

(a) a porous image-receiving layer comprising particles selected from the group consisting of fumed or colloidal silica, fumed or colloidal alumina, boehmite, and mixtures thereof, the average primary particle size of which is under 100 nm; and (b) under the porous image-receiving layer, a base layer comprising a polymeric binder and at least 80% by weight of inorganic particles, wherein the inorganic particles comprise silica gel and precipitated calcium carbonate, at least 80% by weight of the inorganic particles comprising precipitated calcium carbonate, the precipitated calcium carbonate comprising at least 25% by weight of scalenohedral calcium carbonate particles, having an average particle size of 0.1 to 5 micrometers, and at least 5% by weight of precipitated calcium carbonate having one or more morphologies selected from the group consisting of prismatic, acicular, and combinations thereof.

* * * * *

UNITED STATES PATENT AND TRADEMARK OFFICE

CERTIFICATE OF CORRECTION

PATENT NO. : 7,553,526 B2
APPLICATION NO. : 11/302875
DATED : June 30, 2009
INVENTOR(S) : Bruce C. Campbell et al.

It is certified that error appears in the above-identified patent and that said Letters Patent is hereby corrected as shown below:

Column 17, claim 3, line 59, delete "ink et"
and insert -- ink jet --.

Column 18, claim 18, line 40, delete "boelimite"
and insert -- boehmite --.

Signed and Sealed this

Eighteenth Day of August, 2009

David J. Kappos

David J. Kappos
*Director of the United States Patent and Trademark Office*